US006453520B2

(12) United States Patent
Borgomanero

(10) Patent No.: US 6,453,520 B2
(45) Date of Patent: Sep. 24, 2002

(54) FASTENING DEVICE FOR THE SHOULDER-STRAP OF A HANDBAG

(75) Inventor: Gianpaolo Borgomanero, Bologna (IT)

(73) Assignee: Acqua di Parma S.r.l., . (IT)

( * ) Notice: Subject to any disclaimer, the term of this patent is extended or adjusted under 35 U.S.C. 154(b) by 0 days.

(21) Appl. No.: 09/911,991

(22) Filed: Jul. 24, 2001

(30) Foreign Application Priority Data

Jul. 31, 2000 (EP) ..... 00830543

(51) Int. Cl.[7] ..... A44B 11/00; A45C 13/00

(52) U.S. Cl. ..... 24/265 EC; 24/193; 24/265 AL; 24/543; 24/3.11; 150/104

(58) Field of Search ..... 24/265 EC, 165, 24/193, 543, 311, 3.11, 265 AL, 597, 563; 150/104

(56) References Cited

U.S. PATENT DOCUMENTS

| | | | | | |
|---|---|---|---|---|---|
| 4,443,917 A | * | 4/1984 | Oddenino | ..... | 24/239 |
| 4,815,175 A | | 3/1989 | Kasai | | |
| 5,178,198 A | * | 1/1993 | Fitzgerald | ..... | 150/107 |
| 5,231,740 A | * | 8/1993 | Mohebkhosravi | ..... | 24/616 |
| 5,774,957 A | * | 7/1998 | Kohl et al. | ..... | 24/701 |

FOREIGN PATENT DOCUMENTS

| | | | | |
|---|---|---|---|---|
| DE | 86 10 143 U | | 8/1986 | |
| EP | 0906732 | * | 8/1998 | ..... 24/265 EC |
| FR | 2578804 | * | 3/1985 | ..... 24/543 |

* cited by examiner

*Primary Examiner*—Victor Sakran
(74) *Attorney, Agent, or Firm*—Leydig, Voit & Mayer, Ltd.

(57) ABSTRACT

The fastening device is for releasably engaging a fastening element connected to one of the ends of the shoulder-strap of a handbag. The device comprises an inner plate-like element to be disposed against an inner surface of the handbag, an outer body to be disposed on an outer surface of the handbag in a position corresponding to that of the inner plate-like element, and to be fixed to the inner plate-like element on the handbag, and a slider mounted for sliding on the outer body and defining therewith a fastening seat which can be opened and closed. The device can reach two alternative positions:

an open position in which the slider is moved along the outer body, against the force of a spring interposed between the outer body and the slider; in this position, the fastening seat is open to permit the insertion or removal of the fastening element of the shoulder-strap, a closed position, in which the slider is acted on by the by spring in order to lock the fastening element of the shoulder-strap in the seat.

9 Claims, 3 Drawing Sheets

15
19
28
20a
20
18a
26
21
30
25
23
31
31
27
16b
16
16a
17
13
14
13
18
32
12
16
32
17
14

15
19
28
20a
20
18a
30
26
21
25
23
16b
16
16a
17a
14
13
18
32
12
16
32
17
17a
14
13

FASTENING DEVICE FOR THE SHOULDER-STRAP OF A HANDBAG

FIELD OF THE INVENTION

The present invention relates to a fastening device for releasably locking one of the ends of a shoulder-strap of a handbag, a bag, or the like.

DESCRIPTION OF THE PRIOR ART

Handbags having shoulder-straps are known in the art. While the shoulder-straps of such handbags may be permanently affixed to such handbags, it is desirable that they be removable.

The object of the present invention is to provide a device of the above-mentioned type which is particularly convenient and practical to use, which locks the shoulder-strap firmly and securely, and which can be fixed easily to a handbag or bag to be carried by means of the shoulder-strap.

This object is achieved, according to the present invention, by an improved fastening device having the characteristics set out in claim 1.

Preferred embodiments of the invention are defined in the dependent claims.

The characteristics and the advantages of the invention will become clear from the detailed description of an embodiment thereof given with reference to the appended drawings, provided by way of non-limiting example, in which:

DESCRIPTION OF AN EXEMPLARY EMBODIMENT

Figure 1:
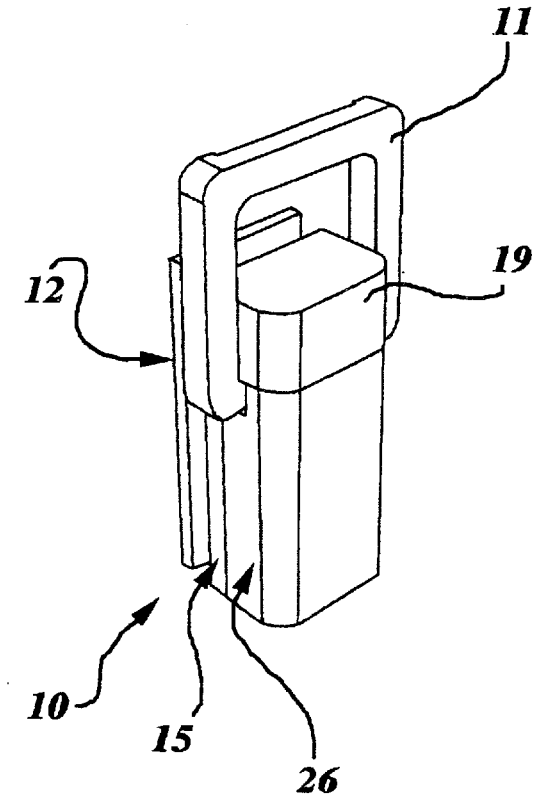
FIG. 1 is a general perspective view of the fastening device according to the present invention in a closed condition in which it locks a ring-shaped element for connection to one of the ends of a shoulder-strap (not shown)

With reference initially to FIG. 1, a device according to the present invention, generally indicated 10, can be fixed to a handbag (not shown) in order to fasten releasably thereto a fastening element 11 which, in the embodiment shown, is of a rectangular or square ring-like shape, and is connected to one of the ends of a shoulder-strap (not shown).

Figure 2:
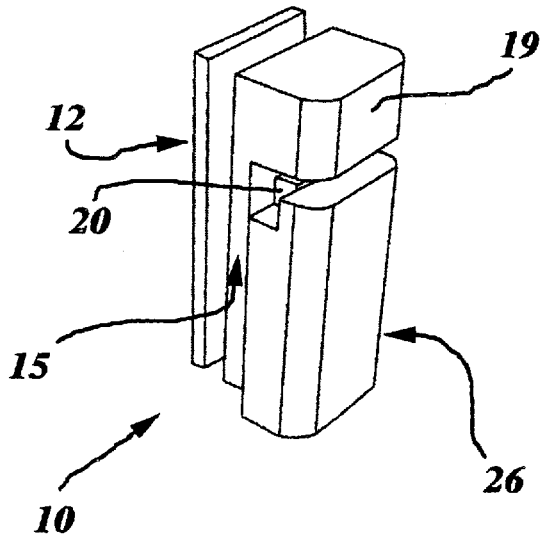
FIG. 2 is a view of the device of FIG. 1 in an open condition in which it allows the fastening ring of FIG. 1 to be inserted or removed.
Figures 4, 5:
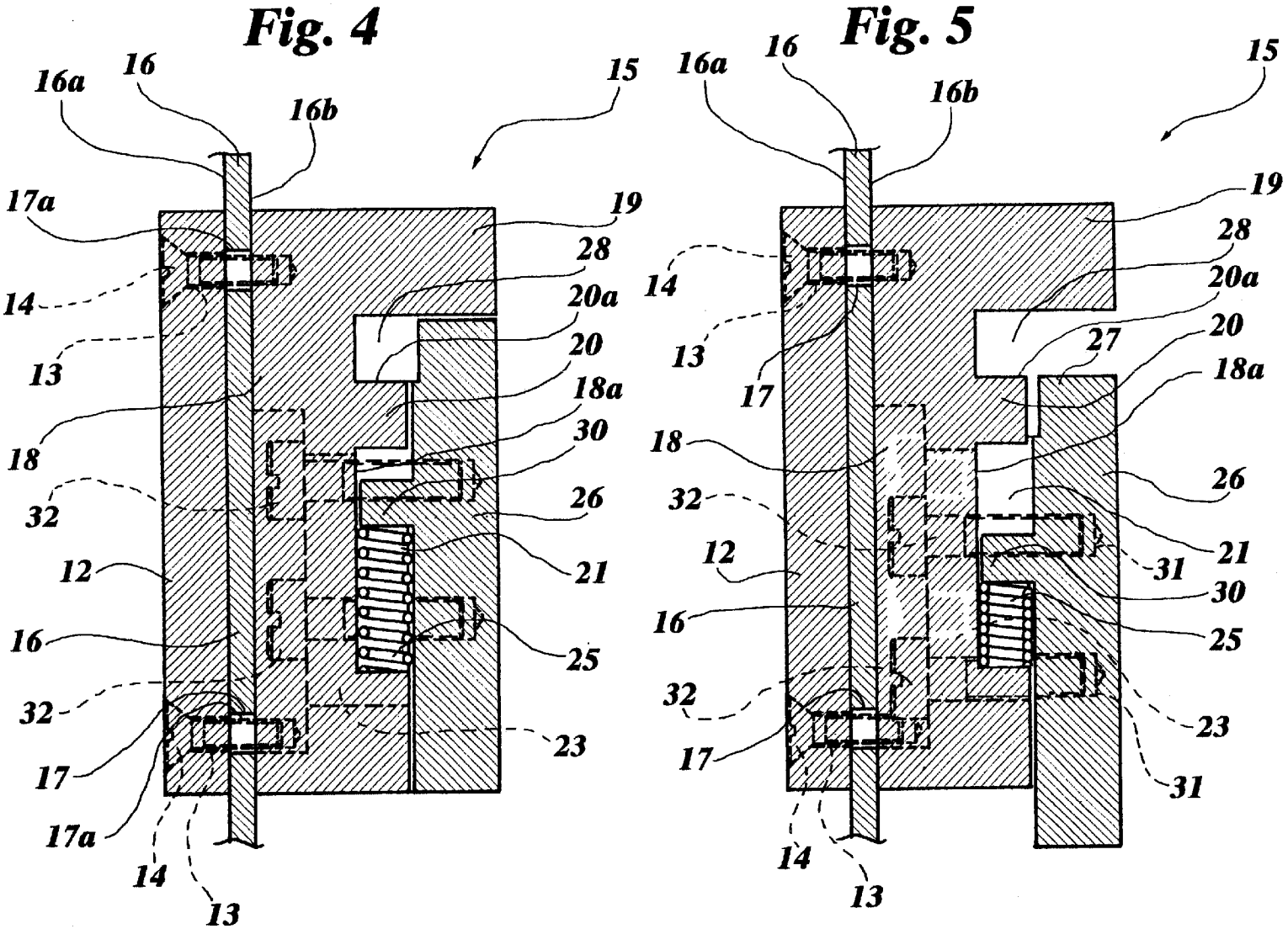

With reference also to FIGS. 2, 4 and 5, the fastening device 10 comprises an inner plate-like element 12 in which there is a pair of holes 13 for receiving corresponding screws 14 which serve to clamp the plate 12 to an outer body 15 forming part of the device. The elements 12 and 15 are clamped together on the inner face 16*a* and on the outer face 16*b* of a handbag 16, respectively.

The outer body 15 has two tubular projections 17 (FIG. 4) in which there are threaded holes 17*a* for housing the screws 14. The tubular projections 17 are aligned with the holes 13 in the plate 12 in a manner such that, when the plate is connected to the body 15, these two elements have substantially congruent profiles in the horizontal direction (FIGS. 1 and 2).

Figure 3:
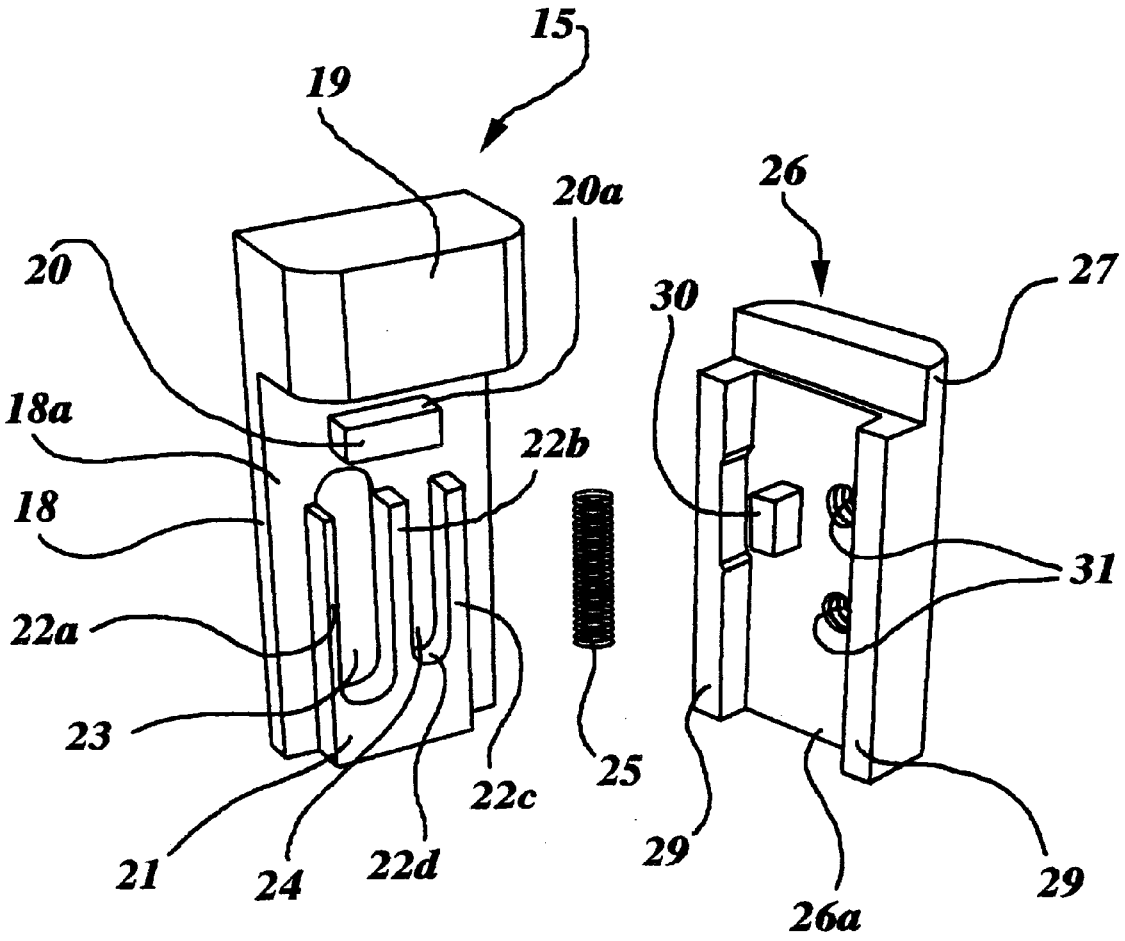
FIG. 3 is a perspective view of some of the components of the fastening device of FIGS. 1 and 2, FIGS. 4 and 5 are side views of the fastening device in the closed and open conditions, in vertical section and on an enlarged scale.

With reference to FIG. 3, the body 15 comprises a substantially rectangular, vertical, plate-like portion 18 from the upper end of which a top portion 19 projects horizontally outwards.

On the face 18*a* of the plate-like portion 18 which is defined herein as the outer face, there are a stop element 20 projecting horizontally beneath the top projecting portion 19, and a shaped portion 21 which also projects horizontally from the surface 18*a* and in which three parallel vertical arms 22*a*, 22*b* and 22*c* are defined. A vertically elongate through-hole 23 is formed in the plate-like portion 18, between the arms 22*a* and 22*b*; a seat 24, in which a spring 25 bears at its lower end and is guided laterally, is defined between the arms 22*b* and 22*c* and their lower connecting region 22*d*.

A slider mounted for sliding vertically on the body 15 is indicated 26. The slider 26 has a thinner upper and outer portion 27 which, together with the lower face 19*a* of the projecting top portion 19 of the body 15 and with the upper portion of the face 18*a* of the body 15, serves to define a seat 28 (FIG. 4) in which a portion of the ring 11 of the shoulder-strap can be fixed.

The seat 28 is defined at the bottom by the upper horizontal face 20*a* of the projection 20 formed integrally with the body 15. The side of the slider 26 which faces the surface 18*a* of the body 15 in use has a pair of vertical, lateral shaped portions 29 which can be guided vertically by the arms 22*a* and 22*c* of the fixed shaped portion 21.

The face 26*a* of the slider which faces the body 15 has a horizontal boss 30 for engaging against the upper end of the spring 25, and a pair of blind threaded holes 31 for receiving the threaded shanks of a respective pair of screws 32 the heads of which are housed slidably on the rear of the vertical slot 23 through which these screws are inserted. As shown in FIGS. 4 and 5, the heads of the screws 32 are advantageously contained within the thickness of the plate-like portion 18 in the fitted condition in order to connect the slider 26 to the body 15 without the heads of the screws 32 scraping against the outer surface 16*b* of the handbag during the vertical sliding movement of the slider.

The fastening device according to the invention operates as follows.

Starting from the condition shown schematically in FIG. 4. in order to lock the ring 11 of the shoulder-strap in the device, the slider 26 is slid downwards against the resilient force of the spring 25 which is further compressed during this stage; the locking seat 28 is thus opened (FIG. 5) and a portion of the ring 11, preferably a substantially straight and horizontal portion, is fitted into the seat 28 by being passed through the clear space defined between the upper portion 27 of the slider and the projecting top portion 19 of the body 15. The slider is then released, allowing the spring 25 to lift the slider by acting on the lower face of the boss 30, thus locking the lower portion of the ring II in the seat 28 (as shown in FIG. 1)

In order to perform the reverse operation, that is, to release the ring 11 of the shoulder-strap, it suffices to slide the slider 26 downwards, compressing the spring 25 again and opening the seat 28.

As will be appreciated, the structure of the fastening device according to the invention is simple and robust which renders the device strong and reliable. It should be noted, in particular, that accidental opening of the device is prevented, owing to the fact that, if the ring 11 is pulled downwards, it does not drag the slider 26 downwards because it is stopped during this movement by the upper face 20*a* of the projecting element 20.

The device may be made of various materials such as plastics or metal, for example brass, and may even have very small dimensions, according to the characteristics of the handbag on which it is fitted.

Naturally, the principle of the invention remaining the same, the forms of embodiment and details of construction may be varied widely with respect to those described and illustrated purely by way of non-limiting example, without thereby departing from the scope of the invention as defined in the appended claims.

What is claimed is:

1. A fastening device for releasably engaging a fastening element connected to one of the ends of the shoulder-strap of a handbag having an inner surface and an outer surface, the fastening device including:

an inner plate-like element to be disposed against the inner surface of the handbag, an outer body to be disposed on the outer surface of the handbag in a position corresponding to that of the inner plate-like element, and to be fixed to the inner plate-like element, on the handbag, a slider mounted for sliding on the outer body and defining therewith a fastening seat which can be opened and closed, resilient means interposed between the outer body and the slider, the device being able to reach two alternative positions:

a first, open position, in which the slider is moved along the outer body, against the force of the resilient means, and in which the fastening seat is open to permit the insertion or removal of the fastening element of the shoulder-strap, a second, closure position, in which the slider is acted on by the resilient means in order to lock the fastening element of the shoulder-strap in the seat.

2. The fastening device of claim 1, wherein the seat is defined at the bottom, at the top, and on the inner side, by three fixed surfaces of the outer body.

3. The fastening device of claim 2, wherein the seat is defined at the bottom by a horizontal surface of a projection formed integrally with the outer body.

4. The fastening device of claim 1, wherein the slider has a horizontal boss projecting towards the outer body for engaging against an upper end of the resilient means.

5. The fastening device of claim 1, wherein the outer body has a vertical plate-like portion with an outer face from which a shaped portion comprising three parallel, vertical arms projects outwardly.

6. The fastening device of claim 5, wherein two of the vertical arms are connected at their lower ends to define a seat in which the resilient means bears at its lower end and is guided laterally.

7. The fastening device of claim 5, wherein a vertically elongate through-hole is formed in the plate-like portion, between two adjacent arms, for the passage of screws for restraining the slider on the outer body.

8. The fastening device of claim 7, wherein the heads of the screws are contained within the thickness of the plate-like portion of the outer body.

9. The fastening device of claim 5, wherein the slider has a pair of vertical, lateral shaped portions which can be guided vertically by two vertical arms of the shaped portion of the outer body.

* * * * *